US005974278A

United States Patent [19]

Nakazawa

[11] Patent Number: 5,974,278

[45] Date of Patent: Oct. 26, 1999

[54] IMAGE FORMATION APPARATUS

[75] Inventor: Nobuo Nakazawa, Toride, Japan

[73] Assignee: Canon Kabushiki Kaisha, Tokyo, Japan

[21] Appl. No.: 09/191,527

[22] Filed: Nov. 13, 1998

[30] Foreign Application Priority Data

Nov. 14, 1997 [JP] Japan ..... 9-313447

[51] Int. Cl.[6] ..... G03G 15/00; G03G 15/08; G03G 15/16

[52] U.S. Cl. ..... 399/55; 399/138; 399/315

[58] Field of Search ..... 399/44, 45, 53, 399/55, 66, 138, 188, 270, 315, 46

[56] References Cited

U.S. PATENT DOCUMENTS

| | | | |
|---|---|---|---|
| 5,128,718 | 7/1992 | Mizoguchi | 399/44 |
| 5,170,210 | 12/1992 | Saruwatari | 399/44 |
| 5,774,762 | 6/1998 | Takemoto et al. | 399/50 |
| 5,845,171 | 12/1998 | Ko | 399/44 |

*Primary Examiner*—Joan Pendegrass

*Attorney, Agent, or Firm*—Fitzpatrick, Cella, Harper & Scinto

[57] ABSTRACT

An image formation apparatus comprises an image bearing member, developing means for developing by use of toner the electrostatic image formed on the image bearing member, transfer charging means for transferring the toner image from the image bearing member to a transfer material in the transfer position, and separation means for de-electrifying the transfer material for separating the transfer material from the image bearing member. Then, after the toner image formed on the transfer material for the first time is fixed, the toner image is formed on the same transfer material for the second time. For this apparatus, modifying means is further provided for modifying the development conditions of the first toner image and the second toner image formed on the transfer material, and modifying the adhesive amount of fogging toner adhering to the image background of the toner image on the image bearing member. With the structure thus arranged, it is made possible to prevent the defective separation and re-transfer, and at the same time, to reduce the development fog as much as possible for a significant enhancement of image formation.

15 Claims, 6 Drawing Sheets

FIG. 3

| | |
|---|---|
| TRN 1 | 500 |
| TRN DUP | 450 |
| TRN OVL | 430 |

IMAGE FORMATION APPARATUS

BACKGROUND OF THE INVENTION

1. Field of the Invention

The present invention relates to an image formation apparatus, such as a copying machine, or a laser beam printer. More particularly, the invention relates to an image formation apparatus provided with developing means for developing, by use of developer, the electrostatic images which are formed on an image bearing member, and also, provided with separation means for separating a transfer material from the image bearing member.

2. Related Background Art

Conventionally, for an image formation apparatus it has been the practice to form electrostatic latent images on the surface of an image bearing member which is charged uniformly by use of primary charging means, with the image exposure given to them corresponding to the image information; to develop the electrostatic images by developing means into the toner images; and to charge a transfer material which is arranged to be closely in contact with the toner images on the surface of the image bearing member, hence transferring the toner images to the transfer material. After that, by use of separation means, the charge applied to the transfer means is partly removed to separate the transfer material from the image bearing member, and then, by use of fixation means, the toner images on the transfer material are fixed. In this way, images are output.

FIG. 7 is a view which schematically shows one example of the conventional image formation apparatus described above. The surface of an image bearing member (photosensitive device) 10 is charged uniformly by a means of the primary charger 11 which is formed by corona charging device. Then, the image exposure 12 is given in accordance with the image information by use of the laser scanner or some other image exposure device (not shown). Thus, the electrostatic latent images are formed on the surface of image bearing member 10 corresponding to the image information. The image exposure 12 is of the type that light is irradiated to the darker (black) portion of the images. The electrostatic latent images formed on the surface of the image bearing member 10 are developed into the toner images by use of the development device 13. In the development device 13, the developer that contains at least toner in it, and with the rotations of an agitator (not shown), a developer bearing member 131 that conveys toner to the surface of the toner image bearing member 10. The toner is then charged to a specific polarity by means of friction charging.

Here, the timing roller 14 and the transfer guide 15 form transfer material conveying means. Then, the transfer material 25, which has been fed by a feeding device (not shown), is conveyed to the surface of the image bearing member 10 to be closely in contact with it by use of the timing roller 14 and the transfer guide 15 in synchronism with the toner images on the surface of the image bearing member 10. After that, the transfer device 16, which is formed by the corona charger, gives to the back face of the transfer material 25 the charge having the reverse polarity of the toner. Thus, by the electrostatic force, the toner images on the surface of the image bearing member 10 are transferred to the transfer material 25.

Subsequent to the transfer process, the transfer material 25 is adsorbed electrostatically to the surface of the image bearing member 10 due to the charge given to the back face thereof. Therefore, by use of the separation device 17, the charge, which is provided in the transfer process, is partly removed to reduce the adsorption between the transfer material 25 and the image bearing member 10 in order to separate the transfer material 25 from the image bearing member 10 by the utilization of the elasticity of the transfer material 25. The separation device 17 is the corona charger that gives the charge having the reverse polarity of the charge given by the transfer device 16 or the one to which AC current is superposed. After a transfer process of the kind, the charge given to the back face of the transfer material is removed to weaken the electrostatic adsorption force between the image bearing member and the transfer material. Then, the transfer material is separated by means of the elasticity of the transfer material. This method is called "the electrostatic separation".

The transfer material 25 thus separated from the image bearing member 10, while holding the toner images, is conveyed to the fixation device 21 by use of the conveying device 20. The toner images on the transfer material 25 are fixed to it by use of the fixation device 21. For the fixation device 21, it is generally practiced to adopt a thermal fixation device which thermally fuses the toner whose main component is resin, and causes it to adhere to the transfer material. The transfer material having the toner images thus transferred to it is exhausted by use of the exhaust roller.

In this respect, if the double-face or multiple transfer should be performed, the transfer material is retained in an intermediate tray in the apparatus, and after that, it is again fed and conveyed to the transfer device for the transfer of the toner images to the transfer material which is separated by use of the separation device 17. It is then exhausted outside the apparatus after the fixation has been made by the fixation device 21.

On the other hand, the cleaning device 18 cleans and removes the slightly remaining toner on the surface of the image bearing member 10 after the toner images have been transferred to the transfer material 25. Then, the electrostatic latent images are removed by means of pre-exposure light 19. In this manner, the next image formation cycle will be performed.

However, there are drawbacks given below as to the conventional art described above. In other words, after the researches and studies made by the inventor hereof, it is found that for the following reasons there are some cases where the stable performance of separation cannot be obtained if the transfer material should be separated by use of the electrostatic separation method subsequent to the transfer process.

Firstly, there is a case where the separation performance becomes unstable due to the difference in the elastic properties (rigidity) of transfer materials. For example, by the changes of moisture content in the transfer material, the elasticity thereof changes accordingly. Therefore, if the image formation apparatus is used under a highly humid environment, the moisture content of the transfer material is increased to make its elasticity smaller. In this case, the separation errors may take place. Also, if the kinds of transfer material differ in the thickness thereof or the like, the separation performance may be affected to vary in some cases.

Secondly, a transfer material exhausted from the fixation device is curled by the application of heat, and if the curling is directed so that it is wound around the image bearing member in case of a multiple transfer, the defective separation or re-transfer may take place in some cases.

Thirdly, the separation capability changes depending on the print ratio of images on the head portion of the transfer material that should be conveyed, and if the print ratio on such portion is low, the defective separation tends to take place. In other words, if there is toner between the transfer material and the image bearing member, a gap may take place to weaken the close contactness between them, hence the separation becoming easier. On the other hand, if there is no toner, the gap between the transfer material and the image bearing member becomes extremely small, thus creating a condition that makes the separation extremely difficult.

Also, the print ratio on the leading end and the trailing end of the transfer material may exert a significant influence on curling. In other words, if an image having a higher print ratio is present on the leading end and trailing end of the first face, the curling becomes greater, and the print ratio of the first face exerts influence on the separation capability of the second face eventually.

Fourthly, there is a case where the separation capability changes greatly even for the same white images depending on the variation of the amount of toner adhesion which may be present slightly on the white background (background portion) of such image (hereinafter, referred to as "fogging toner"). Although the toner amount is small, the fogging toner has a great effect on the electrostatic adsorption to be effectuated between the image bearing member and the transfer material after the transfer process.

For example, if the image formation apparatus is not in use for a long time at night or over the week end, the charge that has been given to the toner in the development device by the friction charging is attenuated. As a result, the development device does not regain sufficient developing characteristics for a while after the image formation apparatus is used again after it has been at rest for a long time. The amount of fogging toner is also made smaller accordingly. In other words, the defective separation may take place more often when the image formation apparatus is used after a long rest.

In order to eliminate the drawbacks described above, there has been adopted conventionally a method whereby the de-electrifying capability of the separation device is made larger to deal with the case that the elasticity of a transfer material is small or the amount of the fogging toner adhesion is small. This conventional method, however, has the drawbacks given below.

If the de-electrifying capability of the separation device is made larger, the electric charge given to the back face of the transfer material (the charge having the reverse polarity of the toner image) is reduced. As a result, the electrostatic adsorption between the transfer material and the surface of the image bearing member is weakened accordingly. Therefore, although the separation of the transfer material becomes possible, the holding power of the charge given to the back face of the transfer material is reduced. Then, there occurs the phenomenon that the toner image once transferred to the transfer material is again attracted and taken away to the electrostatic latent image formed on the surface of the image bearing member when the transfer material is separated from the surface of the image bearing member. Such phenomenon as this is referred to as "re-transfer". If the re-transfer takes place, the density of the output image is made extremely lower, and the image quality is also degraded significantly.

SUMMARY OF THE INVENTION

Therefore, it is the first object of the present invention to provide an image formation apparatus capable of preventing defective separation and re-transfer.

It is the second object of the invention to provide an image formation apparatus capable of modifying the fogging condition of the white background portion at the time of development.

In order to achieve the objects described above, an image formation apparatus of the present invention comprises an image bearing member; developing means for developing by use of toner the electrostatic image formed on the image bearing member; transfer charging means for transferring the toner image from the image bearing member to a transfer material in the transfer position; and separation means for de-electrifying the transfer material for separating the transfer material from the image bearing member. For this apparatus, modifying means is further provided for modifying the development conditions in accordance with the states of the toner image formed on the transfer material, and modifying the adhesive amount of fogging toner adhering to the image background of the toner image on the image bearing member.

BRIEF DESCRIPTION OF THE DRAWINGS

FIG. 3 is a view which shows the screen of the LCD at the time of setting the transfer intensity.

DETAILED DESCRIPTION OF THE PREFERRED EMBODIMENTS

Hereinafter, with reference to the accompanying drawings, the description will be made of the embodiments in accordance with the present invention.

Figure 1:
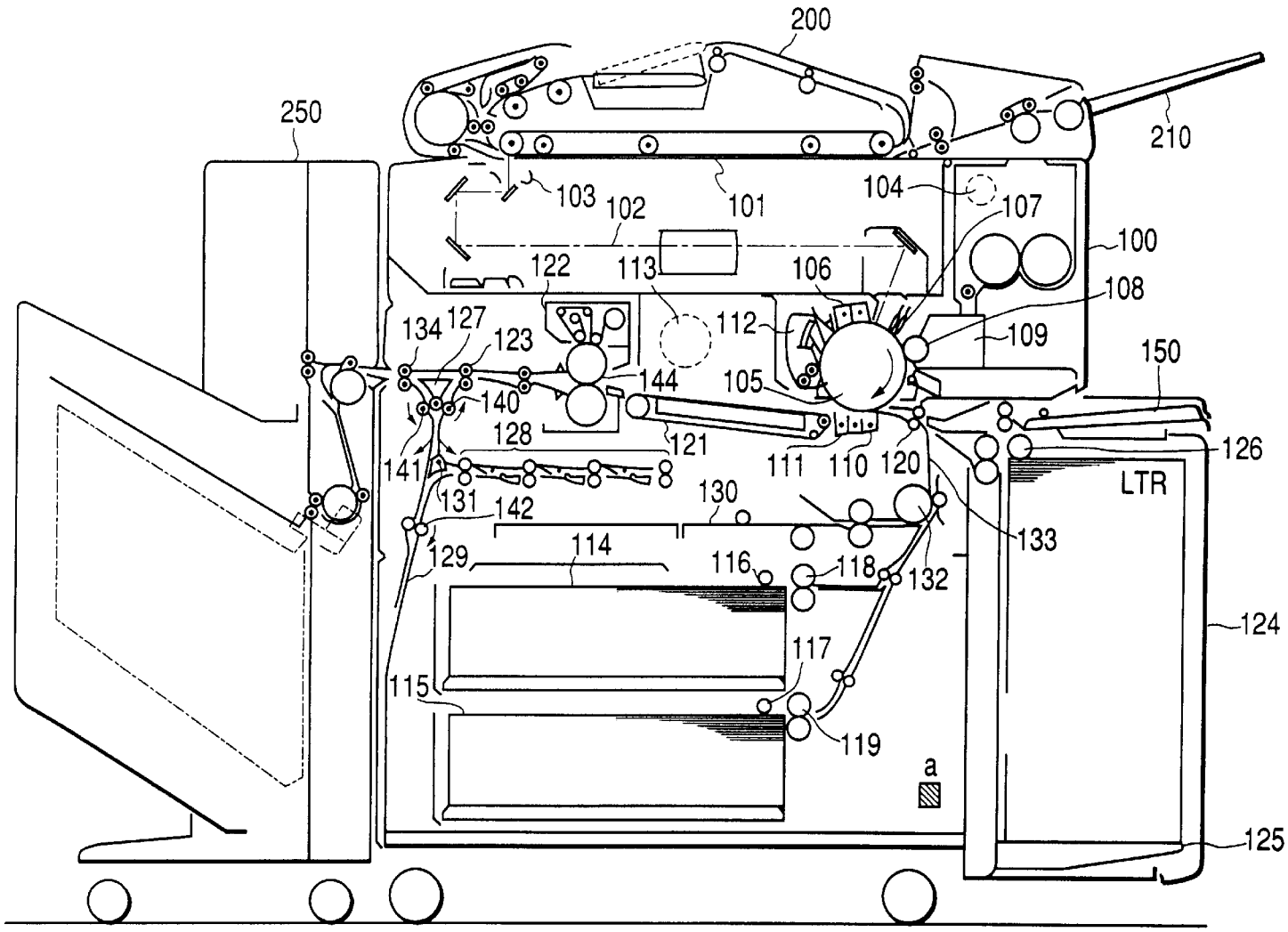
FIG. 1 is a view which shows the structure of an image formation apparatus in accordance with one embodiment of the present invention.

FIG. 1 is a cross-sectional view which shows an image formation apparatus, in which the image formation apparatus is provided with the main body of a copying device 100, a circulating type automatic feeding device of source documents, that is, a feeder (hereinafter referred to as "RDF") 200, and a sorter 250. Here, it is possible to use the RDF 200 and the sorter 250 by freely combining them with respect to the main body 100.

The main body 100 comprises a source document glass stand (a source document stacker) 101; an optical system (image reading means) 102; a source document illuminating lamp (an exposure lamp) 103; a scanning mirror; a lens; a motor 104; and others. A source document is illuminated by the exposure lamp 103 which scans the source document by use of the motor 104. Then, the reflection light from the source document is irradiated to a photosensitive drum 105 by the scanning mirror and the lens.

Around the photosensitive drum 105, are arranged a primary charger 106, a blank exposure unit 107; a potential sensor 108; a developing device 109; a transfer charger 110; a separation charger 111; and a cleaning device 112. With these members and the photosensitive drum 105 and others, image recording means is structured.

The photosensitive drum 105 rotates in the direction indicated by an arrow in FIG. 1 by the main motor 113, and corona charger is applied to it by use of the primary charger 106. Then, when the reflection light form a source document is irradiated by the optical system 102, the electrostatic latent image is formed thereon. The electrostatic latent image is made visible as the toner image when developed by means of the developing device 109. On the other hand, the transfer sheet is conveyed into the interior of the main body 100 by feed roller 118 or 119 either from the upper cassette 114 or the lower cassette 115 by use of the pickup roller 116 or 117. Then, it is conveyed onto the photosensitive drum 105 after the timing is adjusted by the regist roller 120 so that the leading end of the transfer sheet and the head of the toner image are maintained in agreement. Here, by means of the transfer charger 110, the toner image is transferred. To the transfer charger 110, is applied the voltage which has the reverse polarity of the charging polarity of the toner image. The back face of the transfer material is then charged with the reverse polarity of the charging polarity of the toner image.

After the transfer has been executed, the transfer sheet is separated from the photosensitive drum 106 by use of the separation charger 111, and guided to the fixing device 122 by the convey belt 121 for its fixation to be made by the application of heat under pressure. Subsequently, the fixed transfer sheet is exhausted by the exhaust roller 123 outside the main body 100. To the separation charger 111, applied is the DC voltage provided with the polarity opposite to that of the voltage applied to the transfer charger or the DC voltage of the kind which is superposed with AC voltage, hence partly de-electrifying the transfer charge applied to the back face of the transfer material after the transfer has been performed. Also, the surface of the photosensitive drum 105 is cleaned off by means of the cleaning device 112.

Also, for the main body 100, a paper deck 124 is provided so as to store 4,000 transfer sheets, for example. The lifter 125 is arranged to be elevated corresponding to the amount of stored transfer sheets so that the transfer sheet is always in contact with the feed roller 126. This apparatus is provided with the both-face mode in which, after images are formed on one face of a transfer material, images are formed on the other face thereof. This apparatus is also provided with the multiple mode in which, after images are formed on one face of the transfer material, other images are formed on the same face thereof. The exhaust sheet flapper 127 switches the passage of the transfer sheet on the both-face recording side or the multiple recording side, and that of the exhaust (the sorter 250) side. The transfer sheet fed out from the exhaust roller 123 is directed either to the both-face recording side or to the multiple recording side by this exhaust sheet flapper 127. The lower convey path 128 enables the front/rear face of transfer sheet fed out from the exhaust roller 123 to be reversed through the reversing path 129, and guided to the re-feed tray 130. When the multiple flapper 131 is brought down in the left-hand direction, the transfer sheet is guided directly to the lower convey path 128 without the intervention of the reversing path 129.

The feed roller 132 feeds the transfer sheet to the photosensitive drum 105 side through the passage 133. The exhaust roller 134 is arranged in the vicinity of the exhaust sheet flapper 127, and the transfer sheet is exhausted outside the apparatus if the exhaust sheet flapper 127 is switched over to the exhaust side. When the both-face recording (the both-face copying) or the multiple recording (the multiple copying) is performed, the exhaust sheet flapper 127 is brought up to store the copied transfer sheet in the re-feed tray 130 in the reversed condition obtainable through the convey paths 128 and 129. At the time of both face recording, the multiple flapper 131 is brought down in the right-hand direction. At the time of multiple recording, the multiple flapper 131 is brought down in the left-hand direction.

When the reversed face recording or the multiple recording is performed, the transfer sheet stored in the re-feed tray 130 is guided by means of the feed roller 132 to the re gist roller 120 of the main body through the passage 133. When the transfer sheet is exhausted from the main body in the reversed condition, the exhaust sheet flapper 127 is brought up so that the flapper 131 is brought down in the right-hand direction. Thus, the copied transfer sheet is conveyed to the convey path 129 side. After the trailing end of the transfer sheet has passed the first feed roller 140, it is conveyed by means of the reversing roller 142 to the second feed roller side. Then, by means of the exhaust roller 134, the transfer sheet is exhausted outside the apparatus in a reversed posture.

Figure 2:
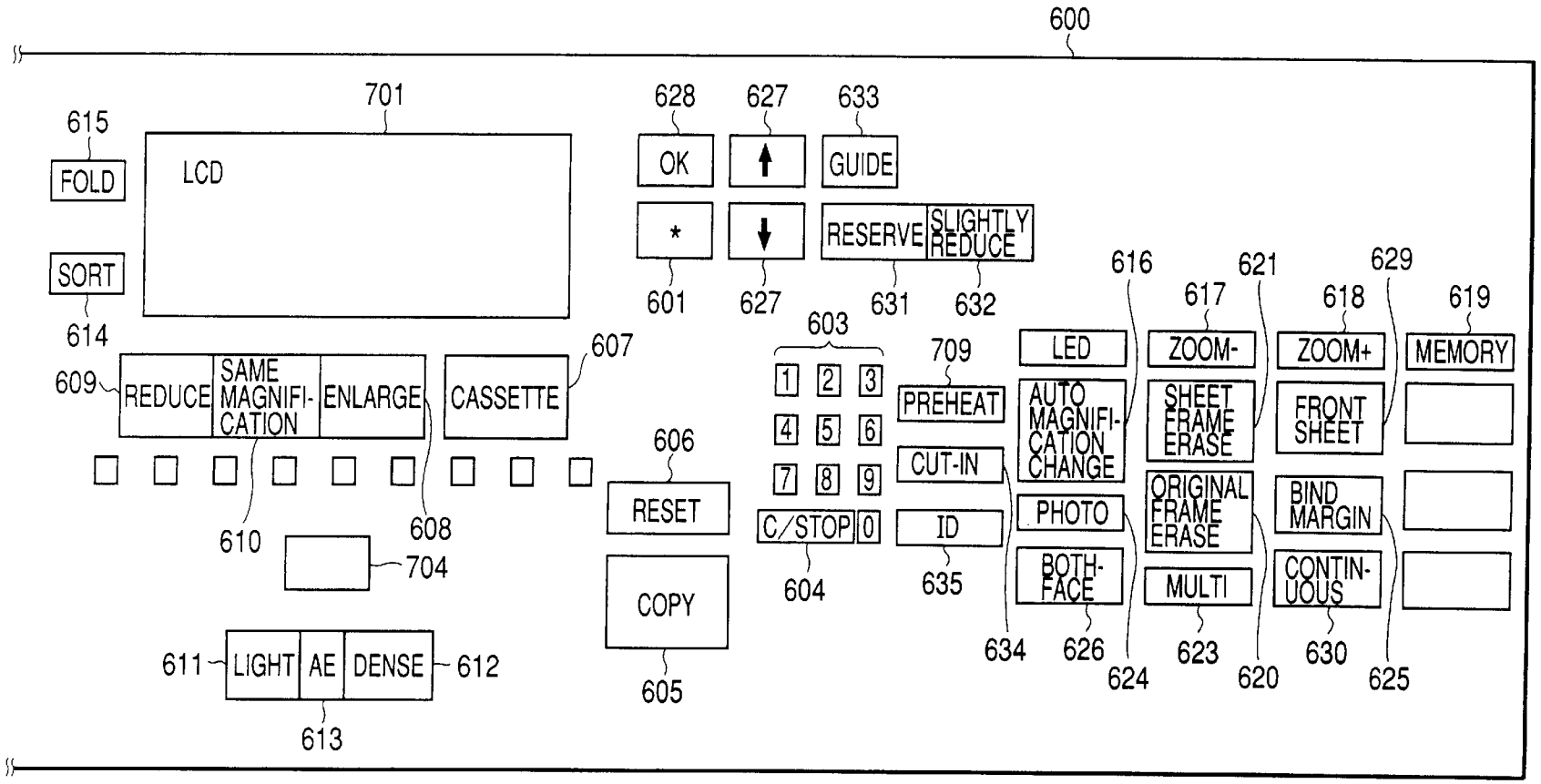
FIG. 2 is a view which illustrates the operation unit of the image formation apparatus in accordance with the present invention.

FIG. 2 is a view which shows the structural example of the operation unit 600 arranged for the main body 100.

In FIG. 2, the key 601 marked with an asterisk (*) is used by the operator (user) when he selects a mode such as to set the binding margin, to set the size in which to eliminate the frame of an original document, or the like. The cursor key 627 is used when selecting each item of the mode to be set. The OK key 628 is used to establish the content of each setting in the mode thus selected. The all reset key 606 is depressed when the selected mode should be returned to the standard mode, and also, when the automatic shut off status should be returned to the standard mode. The copy initiation key (copy start key) 605 is depressed to begin copying. The clear/stop key 604 is provided with the function of a clear key in the standby status, and the function of a stop key during the copy recording. The clear key is also usable when releasing the currently set number of copying sheets. Also, the stop key is depressed to suspend the continuous copying.

The ten keys 603 are used for setting the number of copying sheets, and also, for setting the respective * (asterisk) modes. The memory key 619 is used for registering in advance the copying mode that the user often operates, and also, used for setting the mode whereby to call the registered copying mode. The copy density keys 611 and 612 are depressed if the copy density should be adjusted manually. The AE key 613 is depressed when the copy density should be adjusted automatically corresponding to that of the source document to be copied or it is depressed to release the AE (automatic density adjustment) and to switch it over to the manual adjustment. The copy sheet selection key 607 is depressed when selecting the upper paper lift 119, the lower paper lifter 115, the paper deck 124, or the multiple manual insertion 150. Also, when a source document is placed on the RDF 300, it is possible to select the APS (automatic sheet cassette selection) by use of this key 607, hence selecting the cassette containing the transfer sheets whose size is the same as that of the source document to be currently copied accordingly.

The equivalent key 610 is depressed when the copy is made in the same size (actual measurement) as a source document. The automatic sizing key 616 is depressed to automatically designate the reduction or enlargement of the image on a source document so that it is in agreement with the size of a transfer sheet to be designated. The both face key 626 is depressed when the both face copying is made from a one face source document; when the both face copying is made from a both face source document; or when the one face copying is made from a both face source document. With the binding margin key 625, it is possible to form a binding margin on the left side of a transfer sheet in a designated length. The photographing key 624 is depressed to copy a photographic source document. The multiple key 623 is depressed to form (synthesize) one image on the same face of a transfer sheet from two source documents. The source document frame elimination key 620 is depressed when the user intends to eliminate the frame of a specifically sized source document. In this case, the size of the corresponding source document is set by use of the asterisk key 601. The sheet frame elimination key 621 is depressed when the frame of a sheet (transfer sheet) should be eliminated in order to match it with the size of a copying sheet (transfer sheet).

The front page mode setting key 629 is used for the production of a front sheet, a back face sheet, and an insertion sheet (such as to insert a different kind of transfer material (colored sheet) between white sheets). The page continuation copy key 630 is used when the left and right pages of a spread book is copied continuously. The exhaust selection key 614 is used for the selection of the exhaust methods using the staple sort, sort, and group sort. It is also used to select the staple mode, the sort mode, and the group mode or to release the selected mode for the sheet after recording with the staple sorter being connected. The reservation key 631 is used when beginning the copy mode setting for the reserved source document stacked on the reservation tray 210. Also, it is used when releasing the reserved setting. The slight reduction key 632 is used when the slight reduction mode is applied in order to make the designated copying magnification slightly smaller.

The guide key 633, is used to indicate the explanation of each function of various keys on the screen of the message display. The message display 701 is LCD (liquid crystal display) type that indicates on its screen the information (characters and graphics) related to the copying operations. For example, the display 701 indicates on its screen the number of copies designated by use of the ten keys 603; the copying magnifications set by use of the keys 608 and 609 to change the specific sizes, the key 610 to obtain the same size, and the keys 617 and 618 for zooming use; the size of sheet to be used, which is selected by use of the sheet selection key 607; the messages to indicate the current status of the main body 100 of the copying device; the guide messages to indicate the operational procedures; and other information, such as the contents set for each of the modes.

The AE indication device 704 is illuminated when the AE (automatic density adjustment) is selected by use of the AE key 613. The pre-heating indication device 709 is illuminated when the apparatus is still in the state of pre-heating.

Now, the description will be made a little more in detail as to the setting modes described earlier. The levels of operational setting are classified and arranged in accordance with the knowledge and experience of the users, such as the standard that may be applicable to the general user, the supervisory user, or to the maintenance supervisory user, and the like, respectively. (For example, the operation levels are set by use of identification numbers accordingly). More precisely, the specific level of operation is ready to use. For example, using the * key the general user is able to operate the apparatus at the level suitable for him; by use of the specific ID number plus the * key, the supervisory user is able to operate the apparatus at the level suitable for him; and by use of the specific ID number plus the rhythmical inputs of several specific keys or the like, the maintenance supervisory user is ready to execute his level of operation.

FIG. 3 is a view which shows the example of the display screen of the LCD 700 indicating a part of the items of the setting changes that the maintenance supervisory user may make with respect to the transfer separation in the mode that he can set. Here, the TRN 500 is for the intensity of transfer and 500 is the target value of the intensity thereof. The maintenance supervisory user can adjust them in accordance with the condition in which the user operates the apparatus.

Figure 4:
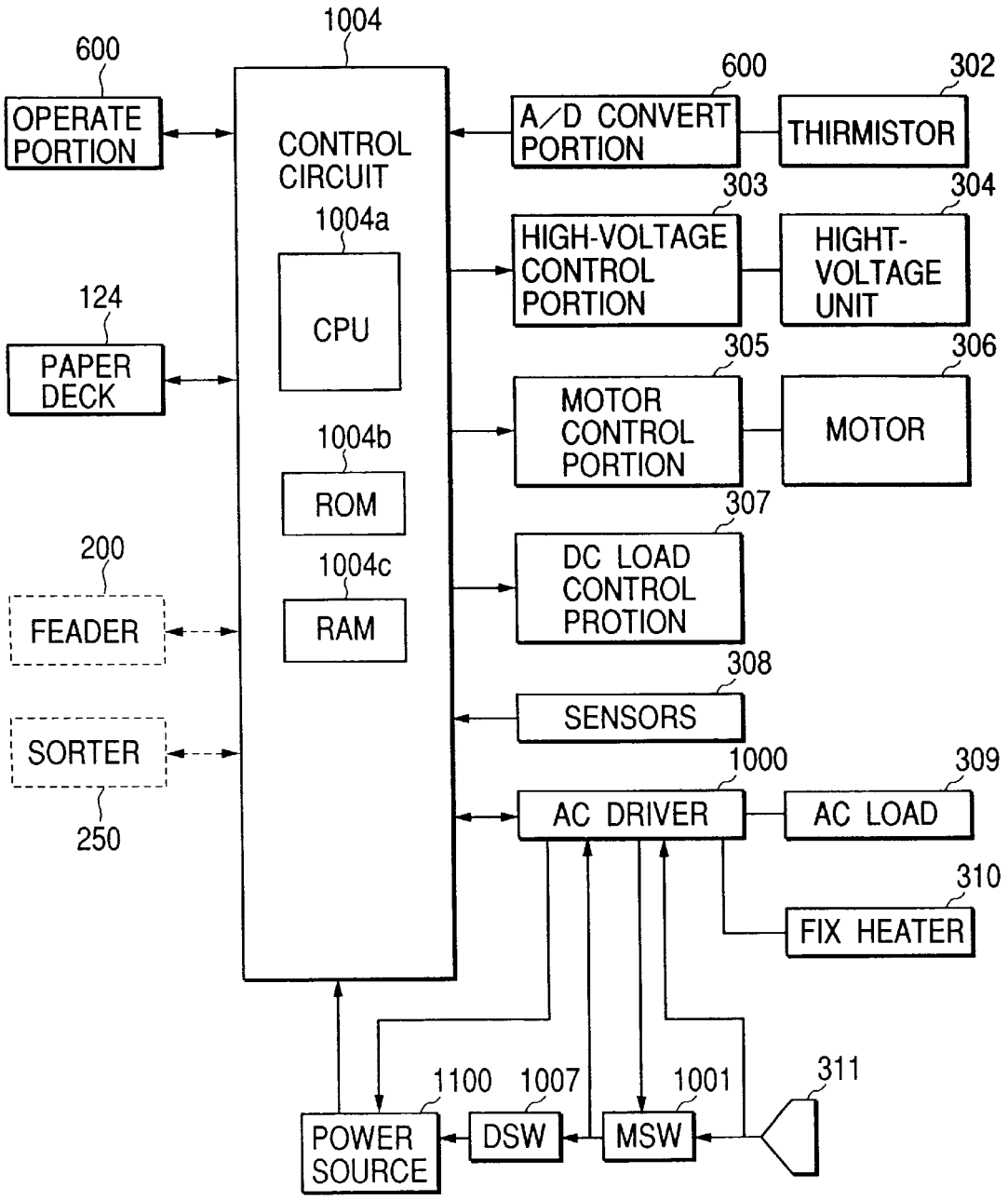
FIG. 4 is a block diagram which shows the control system of the image formation apparatus in accordance with the present invention.

FIG. 4 is a block diagram showing the control system of the image formation apparatus embodying the present invention, in which the control circuit (controller) 1004 comprises the CPU 1004*a*, ROM 1004*b*, and RAM 1004*c*, and others, and performs the overall control of the copying sequence in accordance with the program stored in the ROM 1004*b*.

For the operation unit 600, there are arranged the key input unit, such as the copy mode set up keys (such as one face, both face, multiple mode, copy magnifications, cassette selections), the ten keys to set the number of copying sheets, the start key to instruct the initiation of a copy operation, the stop key to instruct the suspension of the copy operation, the reset key to enable the current operation mode to return to the standard one, as well as the indication unit, such as LED and LCD, which indicate the current status of operation mode or the like.

The thermistor 302 detects the surface temperature of the fixing roller 144. Then, the value which is A/D converted by the A/D converter 301 is inputted into the controller 1004. In accordance with the detected value of the thermistor 302, the controller 1004 controls the surface temperature of the fixing roller 144 so that it is at the predetermined value.

The high-voltage control unit 303 controls the high-voltage unit 304 that applies the predetermined potential to the charging system, such as the primary charger 106, the transfer charger 110, as well as applies it to the development device 109 and the like. The motor control unit 305 controls the driving of motors 306, such as the respective stepping motors, and the main driving motor. The DC load control unit 307 controls the solenoids used for the pickup roller 116 and others, the clutches used for the resist roller 120 and others, and the driving of fans and the like. The outputs of various sensors are inputted into the controller 1004.

The AC driver 1000 controls the AC loads to the source document illumination lamp 103 and others, and also, controls the AC supply-source of the fixing heater 310. Here, this driver detects the abnormality of the source document illumination lamp 103, the fixing heater 310, and others. Then it turns off the main switch 1001 which is provided with the shut off function. Further, the AC inputs before and after the main switch 1001 are switched over by the controller 1004 to be inputted into the power-supply source 1100.

The power-supply source 1100 supplies DC power for use of the controller 1004 and the like. Then, at the same time that AC power is inputted from the AC driver 1000, the AC power is inputted from the input power plug 311 to the power-supply source 1100 through the main switch 1001 and the door switch 1007. The paper deck 124 is the sheet feeding device to deal with the stacked transfer sheets. The feeder 200 is the automatic source document convey device to set the plural numbers of source documents automatically.

The sorter 250 is the sorting device to sort the transfer sheets to be exhausted.

Figure 5:
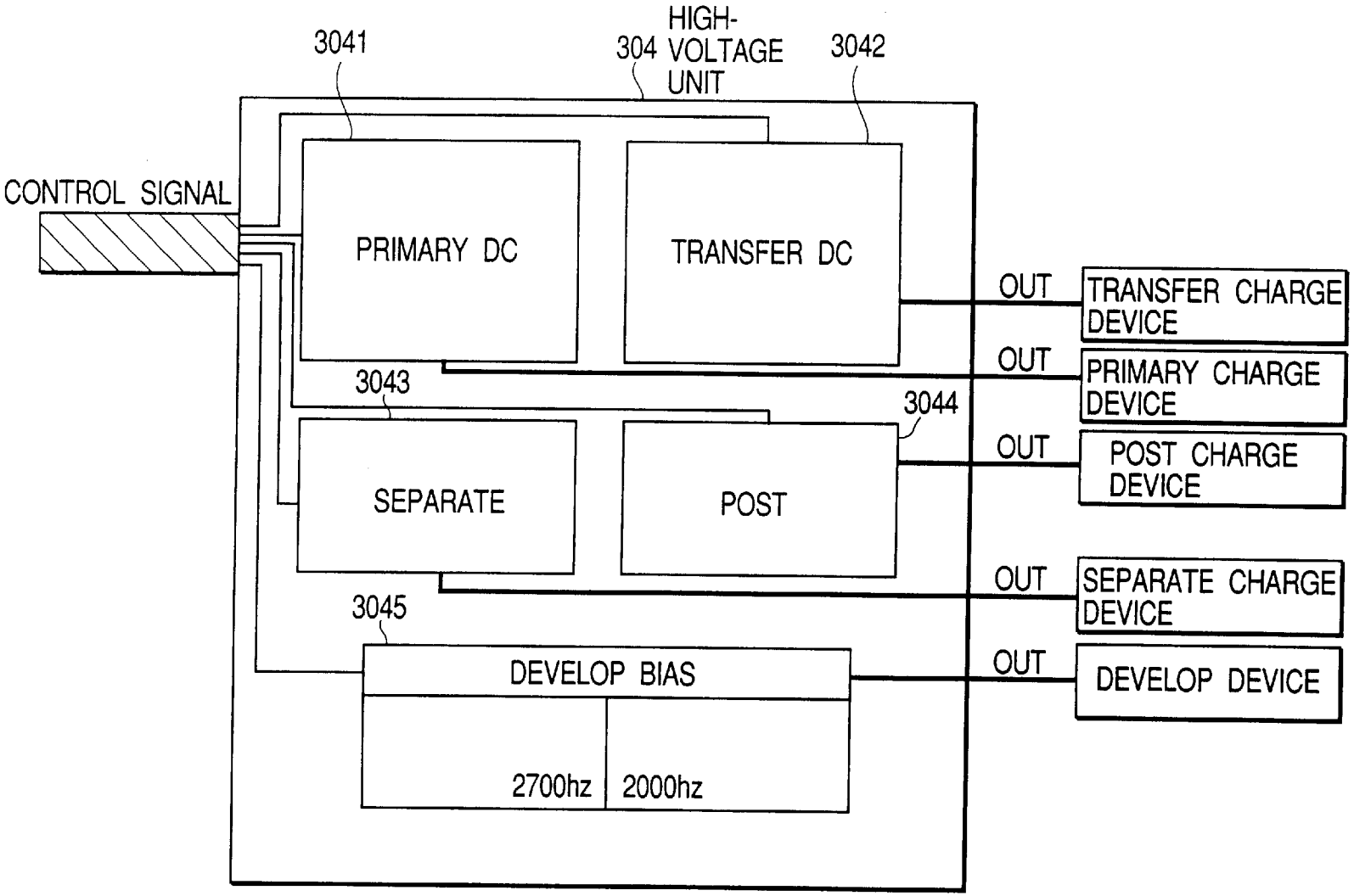
FIG. 5 is a block diagram which shows the high voltage unit of the image formation apparatus in accordance with the present invention.

Now, in order to describe the characteristic aspects of the embodiment of the present invention, the high-voltage unit 304 will be described a little more in detail in conjunction with FIG. 5.

The high-voltage unit 304 comprises the high-voltage DC generator 3041 for primary use; the high-voltage DC generator 3042 for use of supply to the transfer charger; the high-voltage AC plus DC generator 3043 for separation use; the high-voltage AC plus DC generator 3044 for use of the post charger; and the development bias high-voltage generator 3045. For the development bias, there are used the rectangular wave, the wave whose duty ratio has changed, the sine wave, as well as the alternating field which is called slope bias. Then, these having some DC component superposed on them are used as the development bias. The frequencies thereof are selected within a range of 1,000 Hz to several thousands Hz depending on the apparatus to be used and the characteristics of toner to be used. For the present embodiment, however, it is arranged to switch over the development bias generators having the two kinds of slope bias waveforms, each at 2,700 Hz and 2,000 Hz, in accordance with the corresponding signals from the controller 1004. The slope bias waveforms are those in the form of a trapezoid with the flat peak portion of a triangular wave.

Now, for the image formation apparatus embodying the present invention, the Table 1 shows the relationship between the levels of the defective separation re-transfer, and the copy mode, the environmental condition, and the paper conditions.

the re-transfer. To supplement, the optimal setting value of the separation current is caused to vary depending on the environmental conditions. However, since the current is not set optimally, it is impossible to prevent the defective separation and re-transfer even if the setting value of separation current is modified in spite of the fact that the level is not × at which the defective separation or re-transfer may take place. The × level indicated on the Table 1 here such as having been described above. The mark Δ indicates that the optimal latitude is considerably narrow, but it is still usable. The mark ○ indicates that the optimal latitude is wide.

The Table 1 deals with the case where the development bias is used with the provision of the AC voltage of 2,700 Hz, and shows the environment under which the apparatus is left intact; the paper condition; the fogging conditions in the development device; and the modes, as well as the curled conditions. Then, the resultant detective separation and re-transfer levels are listed with respect to these conditions. The fogging toner is the one unstably charged, such as having a smaller charge amount than that of the regular toner or the reverse polarity of the electrostatic charge of the regular toner, and the fogging toner often adheres to the background (white part) of the portion where the regular toner adheres on the photosensitive device.

Generally, the fogging toner is present in a slightly larger quantity in the development device in the lower humid environment, and it is made increasingly smaller as the humidity becomes higher. This fogging toner functions as spacer particles that form a gap between the photosensitive drum and the paper sheet. Therefore, the more the fogging toner is available, the wider becomes the optimal latitude of the separation. The availability of fogging toner exerts the

TABLE 1

Development bias 2,700 Hz

| Environment | Paper condition | Mode | Curled direction | Fogging | Defective separation retransfer level | |
|---|---|---|---|---|---|---|
| Low humidity 5% | Immediately after unpacked | One face | None | Slightly large | ○ | 1-1 |
| | | Both face | Downwardly curled | Slightly large | ○ | 1-2 |
| | | Multiple | Upwardly curled | Slightly large | ○ | 1-3 |
| Normal humidity 50% | | One face | None | Normal | ○ | 1-4 |
| | | Both face | Downwardly curled | Normal | ○ | 1-5 |
| | | Multiple | Upwardly curled | Normal | ○ | 1-6 |
| High humidity 80% | | One face | None | Extremely small | ○ | 1-7 |
| | | Both face | Downwardly curled | Extremely small | ○ | 1-8 |
| | | Multiple | Upwardly curled | Extremely small | x | 1-9 |
| Extremely high humidity 90% | | One face | None | Almost none | Δ | 1-10 |
| | | Both face | Downwardly curled | Almost none | ○ | 1-11 |
| | | Multiple | Upwardly curled | Almost none | x | 1-12 |
| Low humidity 5% | Paper left intact | One face | None | Slightly large | ○ | 1-13 |
| | | Both face | Downwardly curled | Slightly large | ○ | 1-14 |
| | | Multiple | Upwardly curled | Slightly large | ○ | 1-15 |
| Normal humidity 50% | | One face | None | Normal | ○ | 1-16 |
| | | Both face | Downwardly curled | Normal | ○ | 1-17 |
| | | Multiple | Upwardly curled | Normal | ○ | 1-18 |
| High humidity 80% | | One face | None | Extremely small | ○ | 1-19 |
| | | Both face | Downwardly curled | Extremely small | Δ | 1-20 |
| | | Multiple | Upwardly curled | Extremely small | ○ | 1-21 |
| Extremely high humidity 90% | | One face | None | Almost none | x | 1-22 |
| | | Both face | Downwardly curled | Almost none | x | 1-23 |
| | | Multiple | Upwardly curled | Almost none | ○ | 1-24 |

In the Table 1, the level × of the defective separation re-transfer indicates that there is no optimal region (that is, the optimal latitude) between the defective separation and significant influence on the separation capability as it approaches the condition where such toner is almost none. On the other hand, however, its effect on the enhancement of the separation capability is no longer conspicuous even if the quantity of the fogging toner is increased more after it has once reached a certain level of increase. In other words, according to the Table 1, the quantity of the fogging toner is smaller in the extremely humid and high humid environments. In such a case, if the modification is made so as to increase the quantity of fogging toner, it should demonstrate a significant effect on the enhancement of separation.

Now, the description will be made of the curling. Here, the term "upwardly curled" means the curling which is directed to wind around the photosensitive drum at the time of re-transfer separation. The term "downwardly curled" means the curling which is directed the other way around. Then, when the upward curling takes place, the optimal latitude of the separation is made extremely narrower. Therefore, for the separation, the downward curling is favorable. The upward or downward curling occurs without exception when the general fixation equipment is used for fixing toner images by the application of heat. In many cases, the curling takes place in the opposite directions for the transfer effectuated for the both face or multiple image pass. Also, the property of paper changes greatly depending on whether it is dried or moisture-laden. Then, the curling directions are opposite to each other.

Also, the curl is removed or corrected by curl correction means after fixation. However, care is more often given to the both face mode which is usually used, and the resultant curling is downward to make the separation easier. Under the circumstance, therefore, the multiple mode produces the upward curling. Here, in addition, it is readily understandable from the Table 1 that the paper which is left intact under the extremely high humid environment, the curling direction is reversed (compare 1-23, 1-24 with 1-11, 1-12 or compare 1-14 with 1-15). In other words, if the paper is moisture-laden extremely, curling cannot be corrected, and its direction becomes reversed.

Also, as to the level of the defective separation and re-transfer, such level becomes inferior in the multiple mode where the resultant curling is upward. Further, the level of the defective separation and re-transfer becomes inferior under the environment having high humidity where the quantity of fogging toner is smaller. Also, the paper which is left intact under extremely high humid environment shows the inferior level of the defective separation and re-transfer both in the one face and both face modes.

The Table 2 represents the case where the development bias of 2,000 Hz is adopted. What differs from those listed on the Table 1 are the sections regarding the fogging toner. The fogged condition becomes lowered by one grade as a whole. As a result, the defective separation and re-transfer under the extremely high humid environment are improved significantly, which indicates that there is no problem at all as to the one face, both face or multiple mode. Here, the drawback that the fog level becomes lowered does not present any problem if only the development bias of 2,000 Hz is used limitedly only as needed. The defective separation and re-transfer are also improved.

TABLE 2

| | | Development bias 2,000 Hz | | | | |
|---|---|---|---|---|---|---|
| Environment | Paper condition | Mode | Curled direction | Fogging | Defective separation retransfer level | |
| Low humidity 5% | Immediately after Unpacked | One face | None | Large | ○ | 2-1 |
| | | Both face | Downwardly curled | Large | ○ | 2-2 |
| | | Multiple | Upwardly curled | Large | ○ | 2-3 |
| Normal humidity 50% | | One face | None | Slightly large | ○ | 2-4 |
| | | Both face | Downwardly curled | Slightly large | ○ | 2-5 |
| | | Multiple | Upwardly curled | Slightly large | ○ | 2-6 |
| High humidity 80% | | One face | None | Normal | ○ | 2-7 |
| | | Both face | Downwardly curled | Normal | ○ | 2-8 |
| | | Multiple | Upwardly curled | Normal | ○ | 2-9 |
| Extremely high humidity 90% | | One face | None | Small | ○ | 2-10 |
| | | Both face | Downwardly curled | Small | ○ | 2-11 |
| | | Multiple | Upwardly curled | Small | Δ | 2-12 |
| Low humidity 5% | Paper left intact | One face | None | Large | ○ | 2-13 |
| | | Both face | Downwardly curled | Large | ○ | 2-14 |
| | | Multiple | Upwardly curled | Large | ○ | 2-15 |
| Normal humidity 50% | | One face | None | Slightly large | ○ | 2-16 |
| | | Both face | Downwardly curled | Slightly large | ○ | 2-17 |
| | | Multiple | Upwardly curled | Slightly large | ○ | 2-18 |
| High humidity 80% | | One face | None | Normal | ○ | 2-19 |
| | | Both face | Downwardly curled | Normal | ○ | 2-20 |
| | | Multiple | Upwardly curled | Normal | ○ | 2-21 |
| Extremely high humidity 90% | | One face | None | Small | ○ | 2-22 |
| | | Both face | Downwardly curled | Small | Δ | 2-23 |
| | | Multiple | Upwardly curled | Small | ○ | 2-24 |

In this respect, it is preferable to control the constant current for the transfer charger. Both in the both face and the multiple mode, the transfer material that has been once fixed presents greater resistance because it is dried. Therefore, it is preferable to make the current supplied to the transfer charger smaller for the second transfer than the one supplied thereto for the first transfer.

Also, it is better to make the current smaller when it is supplied to the separation charger for the second time (the second face) transfer for the both face mode than the one supplied to thereto for the first time (the first face) transfer. When the AC voltage is applied to the separation charger, it is better to control the differential current between the positive and negative currents using the constant current.

The current supplied to the separation charger for the second transfer in the multiple mode should be made smaller than the one supplied thereto for the first transfer or it is preferable to make it the same as the one supplied to the transfer charger for the first transfer, because the transfer material is subjected to being curled in the direction along the curbed surface of the photosensitive drum in the multiple mode. Now, the specific description will be made of the method to switch over the development bias having the frequency of 2,700 Hz to the one having that of 2,000 Hz.

As described earlier with respect to the mode setting, there are modes arranged to be executable by the general user, the supervisory user, the maintenance supervisory user, or the like, depending on the knowledge and experiences of the respective users. The general user can set the one face mode, the both face mode, the multiple mode, the number of sheets and the binding margins, the frame elimination, the 2 in 1, 4 in 1, 1 to 4 page continuation copying, the paper insertion mode, the photographic mode, the area designation, the image creation mode, and others (these modes are referred to as the "image formation mode" here). The supervisory user and the maintenance supervisory user can set the transfer, the separation, the post chargers, fixation temperatures, various timing, and other modifications of the image formation conditions of the apparatus.

The binding margin mode is the mode to form the white margin on the head of the transfer material, for example, for the provision of the binding margin. The frame elimination mode is the one to form the white margin on each portion corresponding to each of the four sides of a source document so as to eliminate the frame of the source document. It is also the one whereby to form the white margin on each portion corresponding to the four sides of a transfer material so as to eliminate the frame of the sheet. These white margins are provided by use of the blank exposure unit 107 in order to expose the portions of the photosensitive drum where no toner adheres corresponding to the desired white margins by use of the blank exposure unit 107. The 2 in 1 mode, and the 4 in 1 modes are such that two source documents or four source documents are formed on one transfer material. It should be good enough if only a one-time or a two-time image transfer is executed on the same face of a transfer material.

The 1 to 4 mode is opposite to the 4 in 1 mode. For example, from the one source document having four divisional images on it, each one of the four divisional images is formed on each one of four transfer sheets, respectively. The paper inserting mode is such that copying is performed on plural kinds of transfer sheets: for example, during a continuous copying on the ordinary paper transfer material, a colored transfer material is inserted therebetween. The image creation mode is such that a part of an image is processed: for example, the entire body of character images is provided with the meshes of a net.

Now, as the first setting mode, there is provided a selection mode usable for switching over the development biases (here, provisionally referred to as the "bias mode") which is usually used by the supervisory user and the maintenance supervisory user, but which is not necessarily limited to the use of the supervisory user or the maintenance supervisory user. The bias mode may be selected independent of the image formation mode.

If the selection of the first setting mode (bias mode) is 0 (zero), the development bias is always 2,700 Hz irrespective of the modes to be set. If the selection of the bias mode is 1, the development bias frequencies are switched over from 2,700 Hz for the first face use to the 2,000 Hz for the second face use if any one of the multiple pass copying (such as multiple, 2 in 1, or 4 in 1) is selected in the image formation mode. If the bias mode is 2, the development bias of 2,700 Hz is used for one both-face, but that of 2,000 Hz for the send face both in the multiple and both face pass modes when the both face or multiple pass is selected in the image formation mode. If the bias mode is 3, the development bias of 2,000 Hz is set irrespective of the image formation modes.

The Table 4 represents the selections of the development bias frequencies depending on the respective combinations of the bias mode and the image formation mode.

TABLE 4

| | 0 | 1 | 2 | 3 |
|---|---|---|---|---|
| Image formation mode | | | | |
| Both face | | | | |
| first face | 2700 hz | 2700 hz | 2700 hz | 2000 hz |
| second face | 2700 hz | 2700 hz | 2000 hz | 2000 hz |
| Multiple | | | | |
| first face | 2700 hz | 2700 hz | 2700 hz | 2000 hz |
| second face | 2700 hz | 2000 hz | 2000 hz | 2000 hz |
| 2 in 1 | | | | |
| first face | 2700 hz | 2700 hz | 2700 hz | 2000 hz |
| second face | 2700 hz | 2000 hz | 2000 hz | 2000 hz |
| 4 in 1 | | | | |
| first face | 2700 hz | 2700 hz | 2700 hz | 2000 hz |
| second face | 2700 hz | 2000 hz | 2000 hz | 2000 hz |
| One face standard | 2700 hz | 2700 hz | 2700 hz | 2000 hz |
| Binding margin | 2700 hz | 2700 hz | 2700 hz | 2000 hz |
| Frame elimination | 2700 hz | 2700 hz | 2700 hz | 2000 hz |
| Photograph | 2700 hz | 2700 hz | 2700 hz | 2000 hz |
| Others | 2700 hz | 2700 hz | 2700 hz | 2000 hz |

Also, as is clear from the Table 1 and the Table 2, if, for example, the installation environment of the apparatus has lower humidity, it should be good enough to select the bias mode 0 which always provides the development bias of 2,700 Hz at which the latitude is larger so as not to allow the defective separation and re-transfer to take place, and then, the fogging is made smaller accordingly. If the installation environment of the apparatus has higher humidity, it should be good enough to select the bias mode 3 which always provides the development bias of 2,000 Hz at which, although the fogging is larger, the latitude does not allow the defective separation and re-transfer to take place.

Also, if, for example, the installation environment of the apparatus may change, it should be good enough to select the bias mode 1 or 2 so that for the first time (first face) transfer to the transfer material, the development bias of 2,700 Hz is provided at which, although the fogging is smaller, the latitude does not allow the defective separation and re-transfer to take place; and for the second time (second face) transfer to the transfer material, the development bias of 2,000 Hz is provided at which, although the fogging is larger, the latitude does not allow the defective separation and re-transfer to take place. Here, as shown in FIG. 5, the development biases of the bias modes 1 and 2 are different when the second face transfer is effectuated in the both face mode. Therefore, the selection should be made appropriately in consideration of the occurrence of the defective separation and re-transfer with respect to the second face transfer in the both face mode.

As described above, it becomes possible for the maintenance supervisory user or other users to select the favorable conditions (humid condition and the like) and set them appropriately depending on the current circumstances by selecting the development bias switch over with the combined selection of the first setting mode (bias mode) and the image formation mode.

Also, not necessarily limited to the embodiment described above, it is conceivable to make various combinations of the first setting mode selections (bias modes (1, 2, 3, 4, and . . . )) and the image formation mode.

For example, in the frame elimination mode and the binding margin mode, the head of the transfer sheet becomes the white image (the print ratio being smaller). As a result, it is subjected to the defective separation and re-transfer. Therefore, if the first setting mode 4 is selected, the development bias frequency should be switched over to the 2,000 Hz where the fogging takes place more when the above-mentioned image formation mode (frame elimination or biding margin mode) is selected. In this manner, many combinations may become executable.

Second Embodiment

For the embodiment described above, no environmental sensors are used in order to make the structure of the apparatus simpler. Instead, the first setting mode is selected depending on the senses of the maintenance supervisory user or other users. Now, the description will be made of the embodiment in which the humidity sensor and temperature sensor, which are installed on the image formation apparatus, are used for the selection of the first setting mode.

Figure 6:
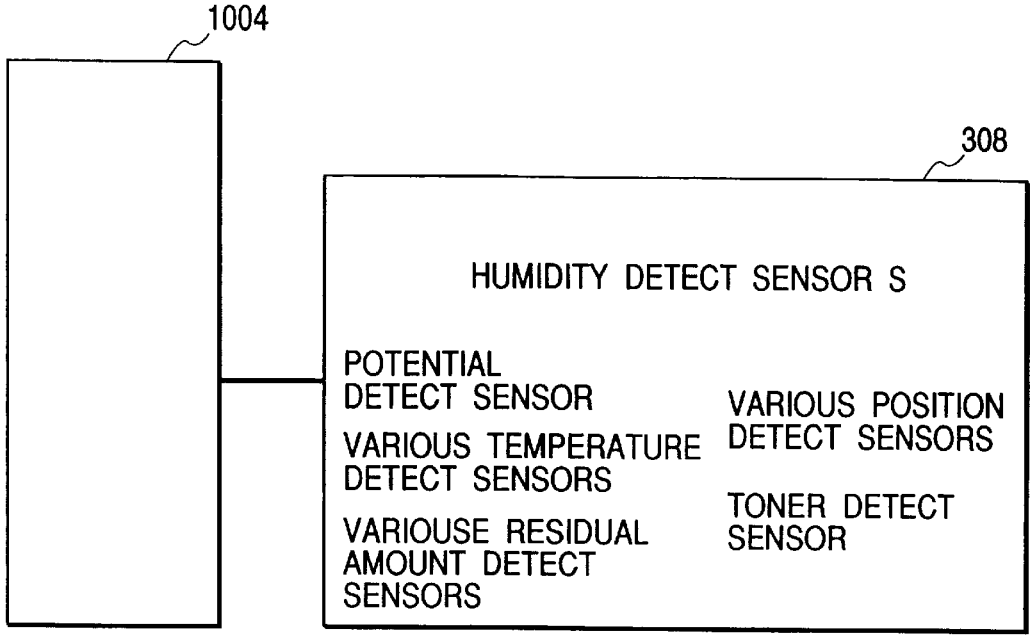
FIG. 6 is a view which shows the control system of the humidity sensor in accordance with the other embodiment of the present invention.
Figure 7:
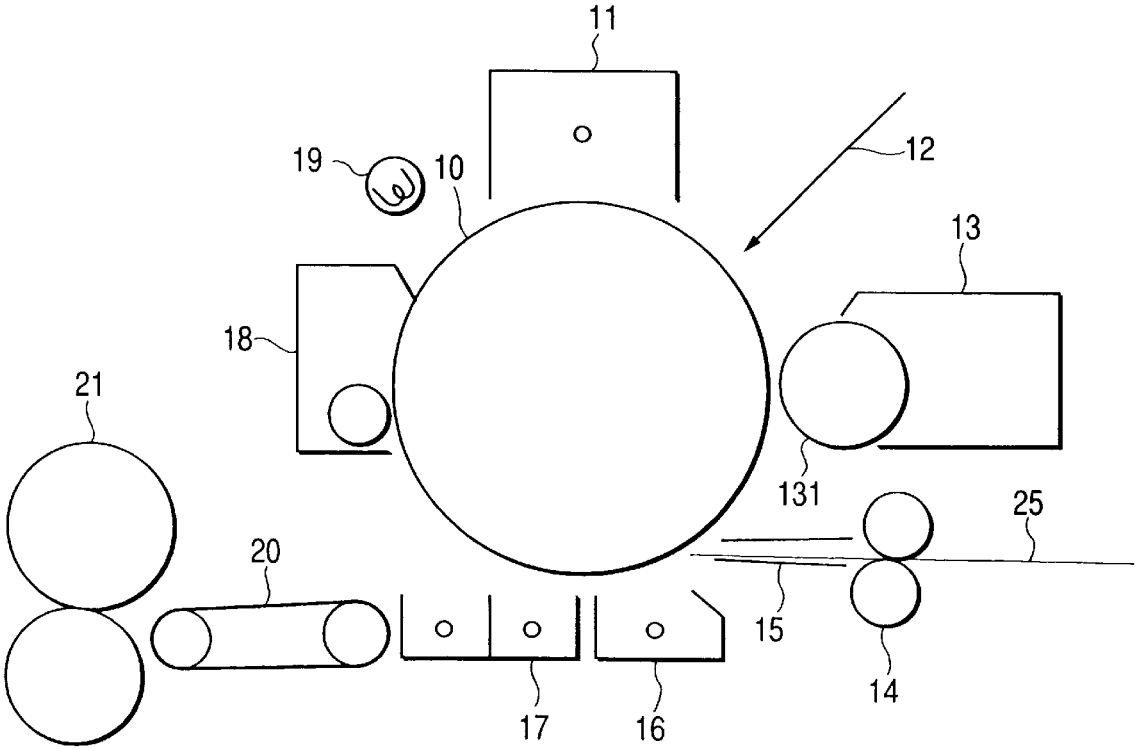
FIG. 7 is a view which schematically illustrates the conventional image formation apparatus.

FIG. 6 is a view which shows the state where the humidity sensor S is connected with the controller 1004 as one of the sensors 308 as shown in FIG. 4. Also, to the controller 1004, there are connected, various sensors for use of positional detection, such as paper sheet position detection sensor, the potential sensor, various temperature detection sensors, the toner sensor, and the various residual detection sensors, among some others. The humidity sensor S is arranged to be positioned at the lower part of the image formation apparatus where the temperature is not easily raised. Now, the description will be made of the changes of the development bias frequencies in response to signals from the humidity sensor S.

If the development bias frequency is lowered, while the development fogging is increased at the time of high humidity, it is understandable that this measure produces a favorable effect on the defective separation and re-transfer in accordance with the results shown in the Table 2.

Also, in accordance with the previous embodiments, the maintenance supervisory user or other users switch over the bias modes 0, 1, 2, and 3 in accordance with the environmental humidity. For this switchover, the humidity sensor is adopted. The Table 3 shows the case where such switching over is effectuated on the basis of humidity.

TABLE 3

| | Bias mode | | | |
|---|---|---|---|---|
| | 0 | 1 | 2 | 3 |
| Humidity | less than 70% | 70% to 85% | 85% to 90% | more than 90% |

Here, if the humidity sensor indicates the value of less than 70%, the bias mode 1 is automatically selected. Then, irrespective of the selections made in the image formation mode, the development bias frequency becomes 2,700 Hz. Then, if the humidity sensor indicates the value of 70% or more and less than 85%, the bias mode 1 is automatically selected, and then, if the multiple pass mode (multiple, 2 in 1, or 4 in 1 mode) is selected for the image formation, the development bias frequency is switched over to 2,000 Hz for the image formation of the second face in the multiple pass mode. Further, if the humidity sensor S indicates the value of 85% or more and 90% or less, the bias mode 2 is automatically selected. Then, if the multiple, 1 in 1, or 4 in 1 mode is selected in the image formation mode, the development bias frequency is switched over to 2,000 Hz at the time of the second face path. Lastly, if the humidity sensor indicates the value of 90% or more, the bias mode 3 is automatically selected. Then, the image is formed all at the frequency of 2,000 Hz irrespective of the image formation mode that the user may select.

With the provision of the humidity sensor described above and the development bias arranged to be changeable, it is unnecessary for the maintenance supervisory user or other users to perform such switching over depending on the seasons and the condition of the apparatus. The development bias is automatically switched over appropriately, hence providing an image formation apparatus that does not present any harmful fogging or the like nor does it create any defective separation and re-transfer.

Third Embodiment

In the second embodiment, the example is shown in which the development bias is automatically switched over by means of the humidity sensor S. In practice, however, the humidity sensor is liable to fluctuate. Also, the fogging or the transfer separation capability of an image formation apparatus is subjected to fluctuations. As a result, there is inevitably the difference that may be present between apparatuses. In order to minimize such difference, it should be good enough if only adjustment means is provided for the absorption of the difference in the last.

To this end, a key is arranged to perform all over shift of each of the humidity values to be switched over at 70%, 85%, 90%, or the like. The bias mode 0 is automatically selected in the case of less than 70%+α; the bias mode 1 is automatically selected in the case of 70+α% to 85+α%; the bias mode 2 is automatically selected in the case of 85+α% to 90+α%; and the bias mode 3 is automatically selected in the case of 90+α%. Then, each of these a values is inputted as adjustment means, which is provided for the setting mode to be made by the maintenance supervisory user. With the arrangement described above, it becomes possible to adjust the difference between apparatuses or the like when the automatic switch over is performed.

Also, in accordance with the embodiment described above, the development bias frequencies are adopted for the fog adjustment. The present invention is not necessarily limited to this method of adjustment. It may be possible to change the development bias voltages (DC voltages or the voltages between peaks). Also, it may be possible to adjust the T/C ratio which is the mixture ratio of the toner and carrier if the two-component developer is used, among some other method that may be adoptable. However, there is a fear that there is a problem of leakage or the like in a case of a development bias voltage. Therefore, it is more desirable to adopt the development bias frequencies for the purpose. Also, in accordance with the embodiment described above, the two-kind development bias frequency is adopted. However, the present invention is not necessarily limited thereto. It may be possible to adopt more kinds of development biases, which are switched over one after another appropriately for the purpose.

Further, the separation capability is caused to vary due to the firmness of a transfer material, such as the thickness of the paper sheet. The smaller the thickness of the paper sheet, the smaller becomes the firmness thereof. As a result, the defective separation from the image bearing member tends to occur. Therefore, if the transfer material whose thickness is smaller than that of the ordinary sheet is used, it may be possible to lower the development bias frequency as described earlier, for example, so that the fogging should be increased more than usual. In other words, it is preferable to modify the development conditions depending on the kinds of transfer materials.

As described above, in accordance with the present invention, the structure is arranged so that the development conditions are modified depending on the difference in the capability of transfer material to be separated from the image bearing member, hence making it possible to prevent the defective separation and re-transfer from taking place, and at the same time, to reduce the development fog as much as possible.

What is claimed is:

1. An image formation apparatus comprising:

an image bearing member;

developing means for developing by use of toner an electrostatic image formed on said image bearing member;

transfer charging means for transferring the toner image from said image bearing member to a transfer material at a transfer position; and separation means for de-electrifying said transfer material and for separating said transfer material from said image bearing member, wherein after the toner image transferred to said transfer material for a first time has been fixed, a toner image is transferred to the same transfer material for a second time, wherein modifying means is provided for modifying development conditions between a case where the first toner image is formed and a case where the second toner image is formed on said transfer material, and modifying an adhesive amount of fogging toner adhering to an image background of the toner image on said image bearing member.

2. An image formation apparatus according to claim 1, wherein said modifying means changes the frequency of an image bias voltage applied to said developing means.

3. An image formation apparatus according to claim 2, wherein the frequency of said image bias voltage applied to said developing means is made lower for the transfer of the second toner image than the frequency applied for the transfer of the first toner image.

4. An image formation apparatus according to claim 1, further comprising detection means for detecting enviornmental conditions, and whether or not said developing means modifies in accordance with the detected results of said detection means, is determined by the formation of the first toner image and by the formation of the second toner image, respectively.

5. An image formation apparatus according to claim 1 or 4, wherein said modifying means makes said development conditions changeable in accordance with a print ratio on a head portion of the transfer material in a conveying direction of said transfer material.

6. An image formation apparatus according to claim 1 or 4, wherein said modifying means makes said development conditions changeable in accordance with a kind of transfer material to be used.

7. An image formation apparatus comprising:

an image bearing member;

developing means for developing by use of toner an electrostatic image formed on said image bearing member;

transfer charging means for transferring the toner image from said image bearing member to a transfer material at a transfer position; and separation means for de-electrifying the transfer material and for separating the transfer material from said image bearing member, wherein modifying means is provided for modifying developing conditions of said developing means in accordance with a conveying direction of the transfer material, and modifying an adhesive amount of fogging toner adhering to an image background portion of the toner image on said bearing member.

8. An image formation apparatus according to claim 7, wherein said modifying means changes the frequency of an image bias voltage applied to said developing means.

9. An image formation apparatus according to claim 7, wherein the frequency of said image bias voltage applied to said developing means is made lower when the print ratio is lower than the frequency applied when the print ratio is higher.

10. An image formation apparatus according to claim 7, wherein said apparatus further comprises detection means for detecting environmental conditions, and wherein the developing conditions are modified in accordance with the detected results of said detection means.

11. An image formation apparatus according to claim 7 or 10, wherein the modifying means makes said developing conditions changeable in accordance with the kinds of the transfer material to be used.

12. An image formation apparatus comprising:

an image bearing member;

developing means for developing by use of toner an electrostatic image formed on said image bearing member;

transfer charging means for transferring the toner image from said image bearing member to a transfer material at a transfer position; and separation means for de-electrifying the transfer material and for separating the transfer material from said image bearing member, wherein modifying means is provided for modifying developing conditions of said developing means in accordance with the kinds of the transfer material to be used, and modifying an adhesive amount of fogging toner adhering to an image background portion of the toner image on said image bearing member.

13. An image formation apparatus according to claim 12, wherein said modifying means changes the frequency of an image bias voltage applied to said developing means.

14. An image formation apparatus according to claim 13, wherein the frequency of said image bias voltage applied to said developing means is made lower when the kind of the transfer material is easier to adhere to said image bearing member electrostatically than the frequency applied when the kind of the transfer material is not easy to adhere thereto electrostatically.

15. An image formation apparatus according to claim 12, further comprising detection means for detecting environmental conditions, and wherein said developing conditions are modified in accordance with the detected results of said detection means.

* * * * *

UNITED STATES PATENT AND TRADEMARK OFFICE

CERTIFICATE OF CORRECTION

PATENT NO. : 5,974,278
DATED : October 26, 1999
INVENTOR(S) : Nobuo Nakazawa

It is certified that error appears in the above-identified patent and that said Letters Patent is hereby corrected as shown below:

Drawings,
Sheet 4, Figure 4, “FEADER” should read -- FEEDER --.

Column 3,
Line 28, “week end,” should read -- weekend, --.

Column 5,
Line 8, “form” should read -- forms --.

Column 6,
Line 13, “re gist” should read -- regist --.

Column 13,
Line 1, “to” should be deleted.

Column 16,
Line 58, “a” should read -- α --.

Signed and Sealed this

Fifteenth Day of April, 2003

JAMES E. ROGAN
*Director of the United States Patent and Trademark Office*